United States Patent [19]

Boothroyd et al.

[11] 4,077,177

[45] Mar. 7, 1978

[54] CURVED ARCHITECTURAL STRUCTURE OF FOAM AND CEMENT

[76] Inventors: Rodney L. Boothroyd, 816 Covington Rd., Belmont, Calif. 94002; Thomas E. Wedge, 2382 Mossdale Way, San Jose, Calif. 95133; Harry E. Aine, 4008 Twyla La., Campbell, Calif. 95008

[21] Appl. No.: 657,499

[22] Filed: Feb. 12, 1976

Related U.S. Application Data

[63] Continuation of Ser. No. 496,157, Aug. 9, 1974, abandoned.

[51] Int. Cl.[2] ..... E04B 1/32

[52] U.S. Cl. ..... 52/741; 52/2; 52/80; 264/32

[58] Field of Search ..... 264/31, 32, 34, 35; 52/2, 741, 74, 80

[56] References Cited

U.S. PATENT DOCUMENTS

| | | | |
|---|---|---|---|
| 2,335,300 | 11/1943 | Neff | 52/2 |
| 2,928,360 | 3/1960 | Heine | 52/80 |
| 3,118,010 | 1/1964 | Harrington | 264/32 |
| 3,277,219 | 10/1966 | Turner | 52/2 |
| 3,289,371 | 12/1966 | Pearson | 52/740 |
| 3,295,278 | 1/1967 | Muhm | 52/223 |
| 3,597,890 | 8/1971 | Hala | 52/86 |
| 3,622,361 | 11/1971 | Pennington | 106/93 |
| 3,643,910 | 3/1969 | Heifetz | 264/32 |
| 3,645,961 | 2/1972 | Goldfein | 52/659 |
| 3,650,785 | 3/1972 | Ball | 52/659 |
| 3,668,287 | 6/1972 | Mackie | 264/32 |
| 3,753,849 | 8/1973 | Duff | 52/DIG. 7 |
| 3,808,085 | 4/1974 | Givens | 52/659 |
| 3,868,296 | 2/1975 | McKeon | 52/309 |

*Primary Examiner*—Price C. Faw, Jr.
*Assistant Examiner*—Henry Raduazo
*Attorney, Agent, or Firm*—Lowhurst & Aine

[57] ABSTRACT

A curved architectural structure is formed by tensioning a membrane into a curved shape and forming an intermediate structure conforming to the contour of the tensioned membrane by applying a rigidizing material such as foam, resin or other lightweight rigidizing material to form a rigidized curved architectural structure or form for same. Cemetitious material having discontinuous reinforcing fibers, as of steel or glass, dispersed therein is applied overlaying a surface of the rigidized structure to shape and support a curved architectural structure of reinforced cemetitious material.

8 Claims, 4 Drawing Figures

CURVED ARCHITECTURAL STRUCTURE OF FOAM AND CEMENT

This is a continuation of application Ser. No. 496,157, filed Aug. 9, 1974, and now abandoned.

BACKGROUND OF THE INVENTION

The present invention relates in general to curved architectural structures of fiber reinforced cementitious material and more particularly to such structures employing a coating of fibrous cementitious material on a rigidized membrane intermediate structure.

DESCRIPTION OF THE PRIOR ART

Heretofore, it has been proposed to tension a membrane into a doubly curved shape, such as a hemisphere by inflation, to apply plastic foam to the membrane to form a rigid light-weight self-supporting doubly curved architectural structure. It has also been proposed to affix steel reinforcing bars or mesh near the surface of the foam structure and to apply concrete, as by gunniting, to the surface of the foam structure to embed the reinforcing steel rods in the concrete layer, thereby providing a reinforced doubly curved foam and concrete architectural structure. Such an architectural structure is disclosed in U.S. Pat. No. 3,277,219 issued Oct. 4, 1966.

It is also known from the prior art, in doubly curved architectural structures of foam and concrete, to employ a wire reinforcing mesh such as chicken wire in one of the concrete layers adjacent an intermediate form or insulation layer. Such a structure is disclosed in U.S. Pat. No. 2,335,300 issued Nov. 30, 1943.

In addition, it is known from the prior art to provide a laminated load bearing heat insulating structural element consisting of an intermediate plastic foam layer and two covering layers of hardened reinforced concrete facing opposite surfaces of the intermediate foam layer. In such a structure, a multiplicity of concrete dowels are extended between the concrete layers through bores in the plastic foam to interlock the concrete layers mechanically. Such a laminated load bearing structural element is disclosed in U.S. Pat. No. 3,295,278 issued Jan. 3, 1967.

The problem with applying a reinforcing wire mesh to a doubly curved architectural structure is pointed out in U.S. Pat. No. 2,892,239 issued June 30, 1959, see column 4, lines 62–67. The problem is that in a doubly curved structure the wire mesh does not properly fit, i.e., contour to such a doubly curved structure without cutting or folding thereby making laying of the reinforcing wire a tedious and time-consuming operation.

Recently, fibrous reinforced concrete has been developed wherein relatively short discontinuous lengths of fibers, typically steel wire or non-round steel strips, have been dispersed in concrete to provide a reinforced concrete structure having a tensile strength of approximately 2 to 3 times that of conventionally reinforced concrete. These recent developments are disclosed in U.S. Pat. Nos. 3,429,094 and 3,650,785 issued Feb. 25, 1969 and Mar. 21, 1972, respectively. It has also been proposed to use fibrous reinforced concrete as a material for a singly curved roof shell. Such an experimental roof shell of ½ inch wall thickness is reported in an article titled "Wirand Concrete . . . A New Structural Material" appearing in *Concrete Construction* of July 1971, pages 276–278.

SUMMARY OF THE PRESENT INVENTION

The principal object of the present invention is the provision of an improved curved architectural structure of foam or other rigidizing material and fiber reinforced cementitious material and methods of fabricating same.

In one feature of the present invention, a curved rigid self-supporting foam structure has fiber reinforced cementitious material applied as a layer to one side of the foam structure to contour and support the cementitious material to form a rigid self-supporting curved architectural structure.

In another feature of the present invention, fibrous cementitious material is applied to both sides of the doubly curved rigid self-supporting foam architectural structure, whereby a doubly curved architectural structure of foam sandwich construction is obtained.

In another feature of the present invention, a curved rigid self-supporting structure, to which fibrous cementitious material is to be applied, is formed by tensioning a membrane into a curved shape and applying foam, resin or other rigidizing material to the tensioned membrane, such rigidizing material hardening to form the rigid and self-supporting structure.

In another feature of the present invention, the reinforcing fibers for the fibrous cementitious material have a length in excess of the applied thickness of the cementitious layer or sublayer, whereby a certain degree of orientation of the fibers in the plane of the layer or sublayer is obtained for more efficient utilization of the reinforcing fibers.

In another feature of the present invention, fibrous reinforced cementitious layers on opposite sides of an intervening foam layer have thicknesses less than the thickness of the intervening layer of foam, whereby the composite sandwich has a relatively high section modulus.

In another feature of the present invention, the cementitious fiber reinforced layers on opposite sides of a foam structure are bonded to the intervening foam structure to provide a rigid unitized sandwich construction.

In another feature of the present invention, two fibrous concrete layers on opposite sides of the foam structure are periodically tied together by tie structures passing through the intervening layer of foam to provide a rigid unitized sandwich construction.

Other features and advantages of the present invention will become apparent upon a perusal of the following specification taken in connection with the accompanying drawings wherein:

DESCRIPTION OF THE PREFERRED EMBODIMENTS

Figure 1:
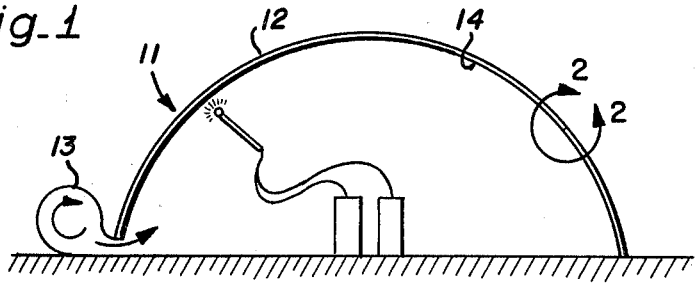
FIG. 1 is a schematic line diagram, in vertical section, depicting a method for fabricating a synclastic curved architectural structure incorporating features of the present invention.

Referring now to FIG. 1, there is shown a method for fabricating a doubly curved synclastic shaped architectural structure 11 of the present invention. More particularly, an air house form 12 of a desired shape, such as hemispherical, or which may be synclastic, anticlastic or a combination of both, is formed of a suitable membrane material, such as a non-woven or bonded fabric, sealed together along adjacent edges of gore sections. The form 12 is sealed to a base structure and inflated via a suitable blower 13 to tension the membrane into the desired shape of the architectural structure to be fabricated.

The inflated form 12 is sprayed or otherwise coated with a suitable foam material, such as polyurethane, polyvinyl chloride or polyhydric phenolaldehyde resin, as disclosed in U.s. Pat. No. 3,502,610 from the inside or from the outside, as desired, to a suitable thickness and density as of ½ inch to several inches, and 1.0 to 30.0 pounds per cubic foot density, depending upon the span of the building structure 11. The foam hardens, in the case of polyurethane, in a few seconds, to form a rigid self-supporting curved foam architectural structure 14.

Fiber reinforced cementitious material, such as concrete plaster or gypsum plaster using steel fiber, as disclosed in the aforecited U.S. Pat. Nos. 3,429,094 and 3,650,785, preferably the latter, or magnesium oxychloride cement with sawdust or other light-weight fill such as expanded mica, or Perlite, using steel or glass fibers, is applied as by hand troweling to the inside and/or outside of the rigid foam structure. Other suitable cementitious materials include, magnesium oxysulfate, zinc oxysulfate, zinc oxychloride, magnesium oxyphosphate, zinc oxyphosphate, aluminite cement, metal silicates such as calcium silicate and aluminum silicate, pozzolanic cements, and colloidal silic acid. In a preferred embodiment using steel fibers, the reinforcing steel fibers are dimensioned 0.010 inch by 0.022 inch by 1 inch long and comprise 0.5% to 2.50% by volume of the cementitious material (1% to 1.5% being a preferred quantity for best compromize between workability of the mortor and strength of the product). The cementitious fiber-reinforced layers 15 and 16 are preferably laid up with a thickness less than the typical length of the reinforcement fibers 17 such that the fibers are generally oriented in the plane of the respective layers 15 and 16, thereby increasing the efficiency of the reinforcement as contrasted with reinforcement fibers completed randomly oriented in three dimensions within the respective layers 15 and 16.

The foam layer 14 preferably has a thickness in excess of the thickness of the individual fiber reinforced cementitious layers 15 and 16, respectively, to provide a relatively high section modulus for the shell structure of composite foam and reinforced cementitious material.

In case the cementitious material does not form a good bond to the inflatable form material 12 or if the form material is weak, the form 12 is stripped from the rigidized foam structure prior to application of the fiber reinforced cementitious layer 16.

In the case of a foam sandwich type construction, it is desirable to obtain as good a bond as possible between the fiber reinforced cementitious layers 15 and 16 and the intervening foam layer 14. Accordingly, suitable adhesive materials may be coated onto the exterior of the foam before application of the fiber reinforced cementitious material to obtain strong bonds between the cementitious material and the foam structure 14.

Figure 2:
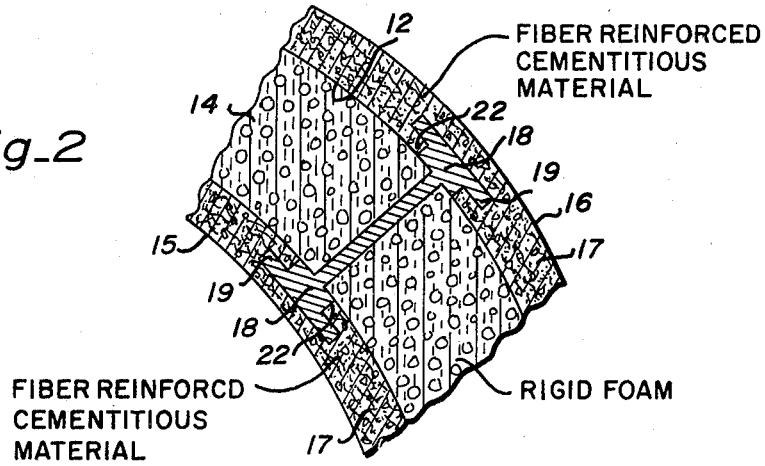
FIG. 2 is an enlarged sectional view of a portion of the structure of FIG. 1 delineated by line 2—2.

In addition, it may be desirable, in certain applications where maximum strength of the shell structure is desired, to provide tie structures interconnecting the cementitious layers 15 and 16 through the intervening foam layer 14. Such a tie structure 18 is shown in FIG. 2 and comprises a pair of perforated disc-shaped head portions 19 interconnected by a rod 21 passing through the intervening foam layer 14. The head portions 19 preferably include spacing collar portions 22 which abut the inner and outer surfaces, respectively, of the foam layer 14 and which serve to space the enlarged head portions 19 of the tie 18 outwardly of the foam layer such that the fiber reinforced cementitious material can be worked completely around and in between the head and the foam. In this manner the heads 19 are completely embedded in the fiber reinforced cementitious material. In a typical example, the tie rod portion 21 is bonded to one of the head portions 19 and includes a threaded end onto which the other head portion 19 is threadably mated. The tie structures 18 are provided at convenient intervals, such as on two foot centers, and evenly distributed throughout the doubly curved building structure.

Alternatively, dowels of fiber reinforced cementitious material are employed in the manner as disclosed in the aforecited U.S. Pat. No. 3,295,278 for interconnecting the opposite layers 15 and 16 of cementitious material.

Figure 3:
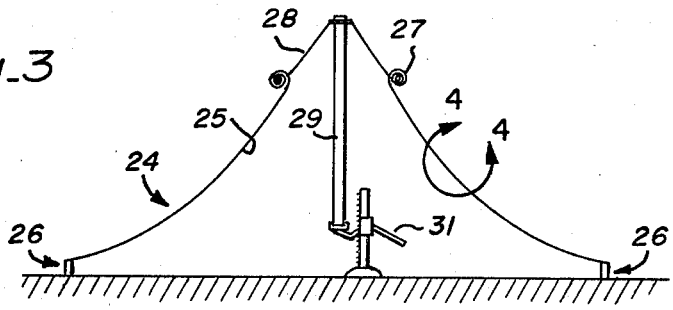
FIG. 3 is a view similar to that of FIG. 1 depicting a method for forming an anticlastic curved architectural structure of the present invention.
Figure 4:
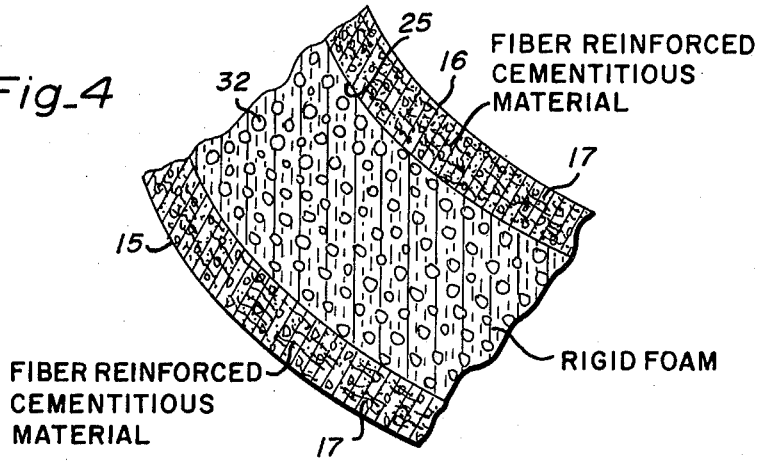
FIG. 4 is an enlarged sectional view of a portion of the structure of FIG. 3 delineated by line 4—4.

Referring now to FIG. 3, there is shown an anticlastic shaped architectural structure of the present invention. Such an anticlastic structure is conveniently formed by securing the outer edge of a membrane 25 to support 26, such as a floor or upper lip of a vertical wall. A ring 27 is secured to the membrane 25 at a point generally centrally disposed of the membrane 25. The membrane is then stretched out of the plane of support 26 as by pulling the ring 27 by tension cables 28 affixed to a lifting post 29 which is lifted above the plane of the support via a suitable means, such as a jack 31. As the elastic membrane 25 is distended or stretched it assumes the anticlastic shape.

The anticlastic shape membrane 25 is sprayed or otherwise coated with foam to form a rigid, self-supporting foam structure 32 contoured to the shape of the tensioned membrane and to which one or more layers of fiber reinforced cementitious material are applied on one or both sides to form an anticlastic shaped fiber reinforced structure of cementitious material in the manner as previously described with regard to FIGS. 1 and 2. The resultant anticlastic architectural structure, such as a roof, can be supported at its base to place the structure in compression or can be supported by a central post to place the structure in tension.

Thusfar in the description of the invention, the rigid self-supporting foam building structure has been doubly curved. While the invention is particularly useful for doubly curved structures it is also useful for a singly curved structure, such as a cylinder, cone, simple arch, etc. In addition, the fiber reinforced cementitious layers need not be applied to both sides of the curved foam building structure but may be applied to only one side, either the inside or the outside.

In a preferred embodiment, the fiber reinforced cementitious material is applied to the inside of the foam layer 14 or 32 as layer 15. Layer 15 has sufficient thickness to support the full load to be placed upon the architectural structure. In the case of relatively large high strength architectural structures, the thickness required for layer 15 is preferably not entirely supported by the foam structure. Thus, the inside self-supporting layer 15 is built up in successive layers to the required thickness. More particularly, a first inside layer 15 of fiber reinforced cementitious material is applied to a thickness that will cling to and be supported from the inside surface of the foam structure without falling off. This first layer is allowed to cure into a rigid self-supporting shell. Successive layers of the cementitious material, which may or may not be fiber reinforced, are applied overlaying the inside scratched surface of the first layer 15 and are supported by the first and successively cured and scratched layers 15, of the cementitious material. Scratching provides a mechanical interlock between adjacent layers. The foam layer 14 or 32 may be removed, but in a preferred embodiment it is left intact as a liquid impervious layer for sealing and thermally insulating the inside shell 15 of cementitious material. A relatively thin outside layer of cementitious material is preferably applied over the outside of the foam structure 14 or 32 for protecting the foam from the sun and elements. The outside foam layer 14 or 32 provides thermal lagging for the inner shell 15, thereby reducing thermal shcok and resultant cracking of the inner shell. This is particularly desirable during curing of the inner shell 15 especially when the cementitious material of shell 15 is concrete. In addition the foam layer 14 or 32 helps to seal and to retain the moisture within the curving layers of concrete during curing for obtaining maximum strength of the concrete.

While employing fiber reinforced cementitious material greatly facilitates each of fabrication, it may be desirable in certain cases to incorporate additional reinforcement. In such a case, the fiber reinforced cementitious material may be applied over conventional reinforcing mesh or bars.

As an alternative to use of pure polyurethane foam as the rigidizing material used herein, the foam may include other constituents for fire proofing the foam or making the foam open cell as opposed to closed cell type to make the thermal expansion characteristics of the foam closer to that of the overlaying cementitious material especially in the case of a foam sandwich construction. More particularly, magnesium oxychloride or cement may be incorporated into the polyurethane foam to make the foam non-combustible. Also other cofoam materials may be incorporated with the primary foam constituent. Also, the light-weight rigidizing material 14 or 32 need not be an organic plastic foam material but may comprise inorganic foamed materials. Examples of suitable foamable cementitious materials both organic and unorganic are disclosed in U.S. Pat. No. 3,050,427. In addition, the rigidizing material need not be a foam but may comprise a resin material such as epoxy resin.

The advantages of a curved architectural structure employing foam and fiber reinforced cementitious material according to the present invention is that the structure is more easily fabricated because the previous requirement for laying up the reinforcement mesh on a curved, particularly a doubly curved, surface is eliminated, thereby greatly reducing the labor required to fabricate such curved structures. In addition, fiber reinforced cementitious material has greater strength, particularly in tension, and is much more resistive to cracking and spalling than conventionally reinforced concrete. Metallic reinforcing fibers serve to provide improved thermal conductivity for the cementitious layers 15 and 16, thereby reducing the tendency for the structure to generate stress due to uneven thermal expansion and contraction. The resultant curved foam and fibrous cementitious structures have reduced weight for a given strength or increased strength for a given weight as compared with conventional wire mesh reinforced structures of similar construction. In the case of the foam and fibrous cement sandwich construction, the cement layers serve to fire proof the resultant structure and to protect the foam from exposure to flame.

What is claimed is:

1. In a method of fabricating a curved architectural structure of the steps of:

tensioning a membrane structure into a doubly curved contour of that of at least a portion of a rigid self-supporting doubly curved architectural structure to be fabricated, applying a fluid non-foamed rigidizing material to the doubly curved contour of the curved tensioned membrane, and rigidizing the fluid material to form said rigid self-supporting doubly curved architectural structure having an upper surface and an opposite downwardly facing underside surface;

forming a layer of cementitious material having discontinuous reinforcement fibers dispersed therein overlaying said underside doubly curved surface of said doubly curved self-supporting rigid architectural structure, said layer of cementitious material being contoured to the contour of the adjacent doubly curved surface of the rigid architectural structure and being initially supported therefrom generally free of other reinforcing structure and being initially generally free of mechanical devices therein for coupling said cementitious layer to said architectural structure, and said layer being adhered to said underside surface of substantially only by the adhesion of said cementitious material to said doubly curved underside surface; and allowing the fiber reinforced cementitious material to harden and become a rigid self-supporting doubly curved fiber reinforced structural member of an architectural structure of fiber reinforced cementitious material.

2. In a method of fabricating a doubly curved architectural structure, the steps of:

forming a rigid self-supporting doubly curved architectural structure of foam;

forming an initial layer of cementitious material having discontinuous reinforcement fibers dispersed therein overlaying a doubly curved surface of said doubly curved self-supporting foam architectural structure, said initial layer of cementitious material being contoured to the contour of the adjacent doubly curved surface of the foam architectural structure and being initially supported thereupon and being generally free of other reinforcement structures therein; and allowing the fiber reinforced cementitious material to harden and become a rigid self-supporting doubly curved fiber reinforced structural member of an architectural structure of fiber reinforced cementitious material.

3. The method of claim 2 wherein the rigid self-supporting doubly curved architectural structure of foam has an upper side and a downwardly facing underside surface;

said layer of cementitious material having discontinuous reinforcement fibers dispersed therein being formed overlaying the underside of the doubly curved surface of said doubly curved self-supporting foam architectural structure, said layer of cementitious material being contoured to the contour of the adjacent doubly curved underside surface of the foam architectural structure and being initially adhered and supported therefrom generally free of other reinforcing structure therein and being supported therefrom generally free of mechanical devices therein for coupling said cementitious layer to said foam structure and being supported from said doubly curved underside surface of said foam structure only by the adhesion of said cementitious layer to said doubly curved underside surface.

4. The method of claim 3 wherein the foam is formed of an open cell foam.

5. The method of claim 3 including the step of applying an adhesive material as a bonding agent to the foam prior to applying said fibrous reinforced cementitious layer to said foam structure for bonding said fibrous reinforced cementitious layer to said foam structure.

6. The method of claim 2 wherein the doubly curved foam structure is a shell and including the step of forming a layer of said fiber reinforced cementitious material overlaying the other doubly curved surface of said doubly curved self-supporting foam shell to form a foam and reinforced cementitious material sandwich shell architectural structure.

7. The method of claim 2 wherein the cementitious material is selected from the group consisting of hydraulic cement, gypsum cement and magnesium oxychloride, the reinforcing fibers are selected from the group consisting of steel, glass, nylon and polypropylene, and wherein the fiber reinforced cementitious material is applied by troweling same overlying a doubly curved contour defined by the doubly curved surface of the rigid foam structure in supportive engagement therewith.

8. In a method of fabricating a curved architectural structure, the steps of:

tensioning a membrane structure into a doubly curved contour of that of at least a portion of a doubly curved architectural structure to be fabricated, applying a fluid non-foamed rigidizing material to the doubly curved contour of the curved tensioned membrane, and rigidizing the fluid material to form a rigid self-supporting doubly curved architectural structure;

forming a layer of cementitious material having discontinuous reinforcement fibers dispersed therein overlaying the doubly curved surface of said doubly curved self-supporting rigid architectural structure, said layer of cementitious material being contoured to the contour of the adjacent doubly curved surface of the rigid architectural structure and being initially supported thereupon and being generally free of other reinforcement structures therein; and allowing the fiber reinforced cementitious material to harden and become a rigid self-supporting doubly curved fiber reinforced structural member of an architectural structure of fiber reinforced cementitious material.

* * * * *